US007818844B2

(12) United States Patent
Wolan

(10) Patent No.: US 7,818,844 B2
(45) Date of Patent: Oct. 26, 2010

(54) MASON'S HAND TROWEL

(76) Inventor: Antoni Wolan, 223 Wisconsin Ave., Wisconsin Dells, WI (US) 53965

( * ) Notice: Subject to any disclaimer, the term of this patent is extended or adjusted under 35 U.S.C. 154(b) by 5 days.

(21) Appl. No.: 12/153,524

(22) Filed: May 20, 2008

(65) Prior Publication Data

US 2009/0288265 A1 Nov. 26, 2009

(51) Int. Cl.
*B05C 17/10* (2006.01)

(52) U.S. Cl. ..... 15/235.4; 15/257.1; 15/257.2

(58) Field of Classification Search ..... 15/257.1, 15/257.2, 235.4, 235.7
See application file for complete search history.

(56) References Cited

U.S. PATENT DOCUMENTS 1,662,170 A 4/1927 Sahlstrom
2,299,418 A * 10/1942 Thomas ..... 294/55
3,408,681 A * 11/1968 Isakson ..... 15/257.2
D278,512 S 4/1985 Lojko
5,425,153 A * 6/1995 Vosbikian ..... 15/257.2
5,975,601 A 11/1999 Spear et al.

* cited by examiner

*Primary Examiner*—Shay L Karls
(74) *Attorney, Agent, or Firm*—Richard C. Litman

(57) ABSTRACT

A hand trowel is provided with upstanding side and rear walls to prevent cement or grout from sliding off when scooped from a container. The sidewalls of the trowel taper to the front edge of the trowel so that no barrier is created to prevent the front edge from being utilized as a "finishing" edge. A handle extends from the rear wall of the trowel. The handle is provided with ergonomic indentations and the front edge is slanted to allow use by either a right- or a left-handed person.

1 Claim, 3 Drawing Sheets

MASON'S HAND TROWEL

BACKGROUND OF THE INVENTION

1. Field of the Invention

The present invention generally relates to hand tools. More specifically, the present invention is drawn to a trowel having retaining walls to prevent grout spillage.

2. Description of the Related Art

The trowel is a bricklayer's most used tool. Conventionally, the trowel comprises a blade having flat under and upper surfaces and a thin front edge. Cement or grout is scooped from a container on the upper surface of the trowel, which grout or cement is then applied to the brickwork. The under surface of the trowel is used to smooth the cement or grout on the bricks. The front edge of the trowel is used to scrape away extraneous cement or grout so as to give a "finished" look to the brickwork.

Unfortunately, using a conventional trowel has a vexing drawback in that a portion of the scooped cement or grout often falls from the upper surface of the trowel thereby causing loss of time and efficiency in the building process. Loss of time and efficiency usually translates into additional costs. The art would certainly welcome a trowel that would better retain cement or grout scooped on the upper surface thereof thereby increasing efficiency and cutting costs. Thus, a hand trowel solving the aforementioned problem is desired.

The related art is replete with trowels and scoop-type devices. Pertinent examples of such related art are cited and identified in the accompanying IDS. However, none of the cited and identified related art, taken either singly or in combination, is seen to disclose a hand mason trowel as will subsequently be described and claimed the instant invention.

SUMMARY OF THE INVENTION

The present invention is a mason's hand trowel provided with upstanding side and rear walls to prevent cement or grout from sliding off when scooped from a container. The sidewalls of the trowel taper to the front edge of the trowel so that no barrier is created to prevent the front edge from being utilized as a "finishing" edge. A handle extends from the rear wall of the trowel. The handle is provided with ergonomic indentations and the front edge of the blade may be slanted to allow use by either a right- or a left-handed person.

Accordingly, the invention presents a trowel that is efficient and easy to use. The invention provides for improved elements thereof in an arrangement for the purposes described that are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
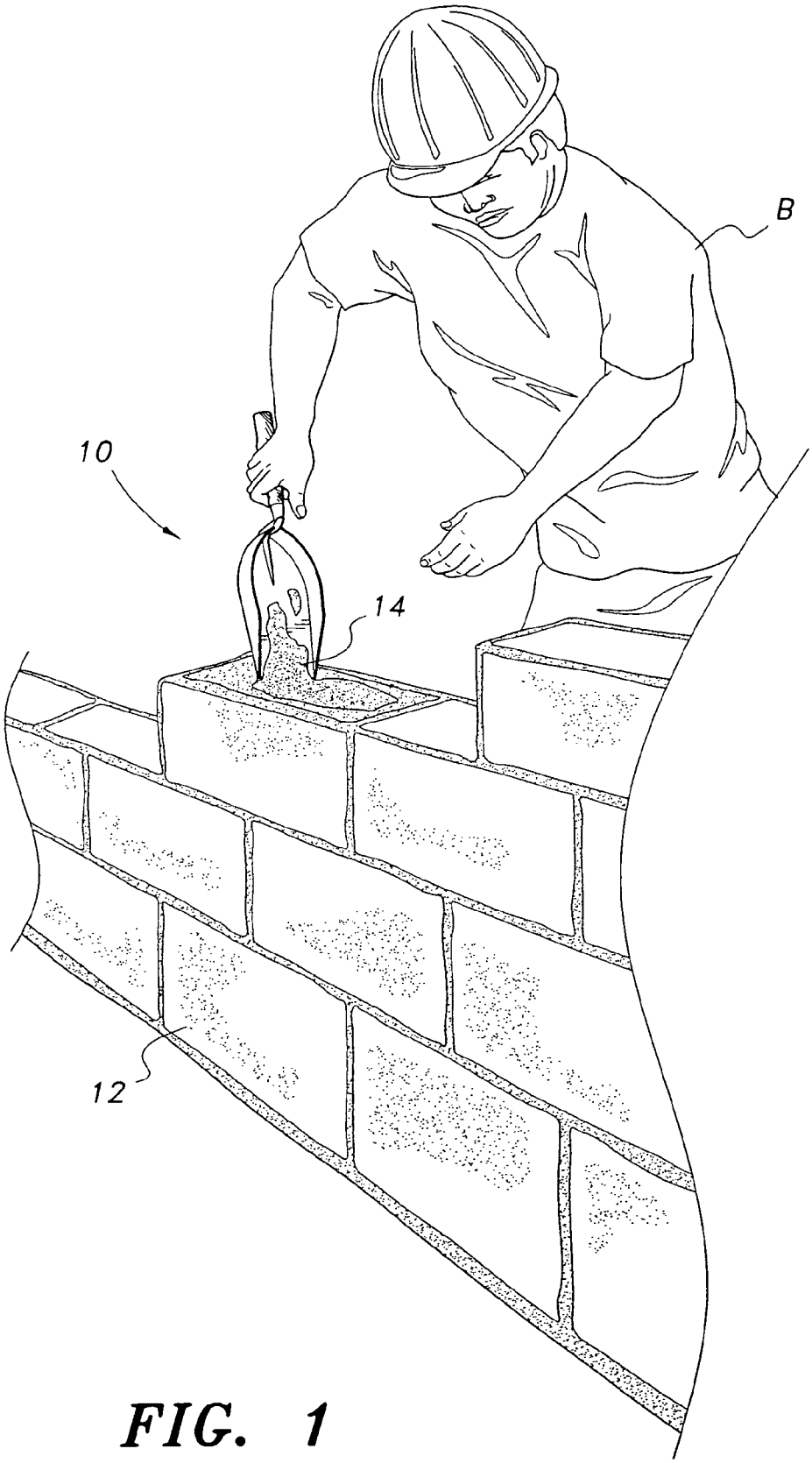
FIG. 1 is an environmental, perspective view of a hand trowel according to the present invention.

Attention is first directed to FIG. 1 wherein the trowel of the invention is generally indicated at 10. As illustrated, a brick mason B is shown constructing a stone barrier 12 and having a portion of mortar 14 disposed in the trowel.

Figure 2:
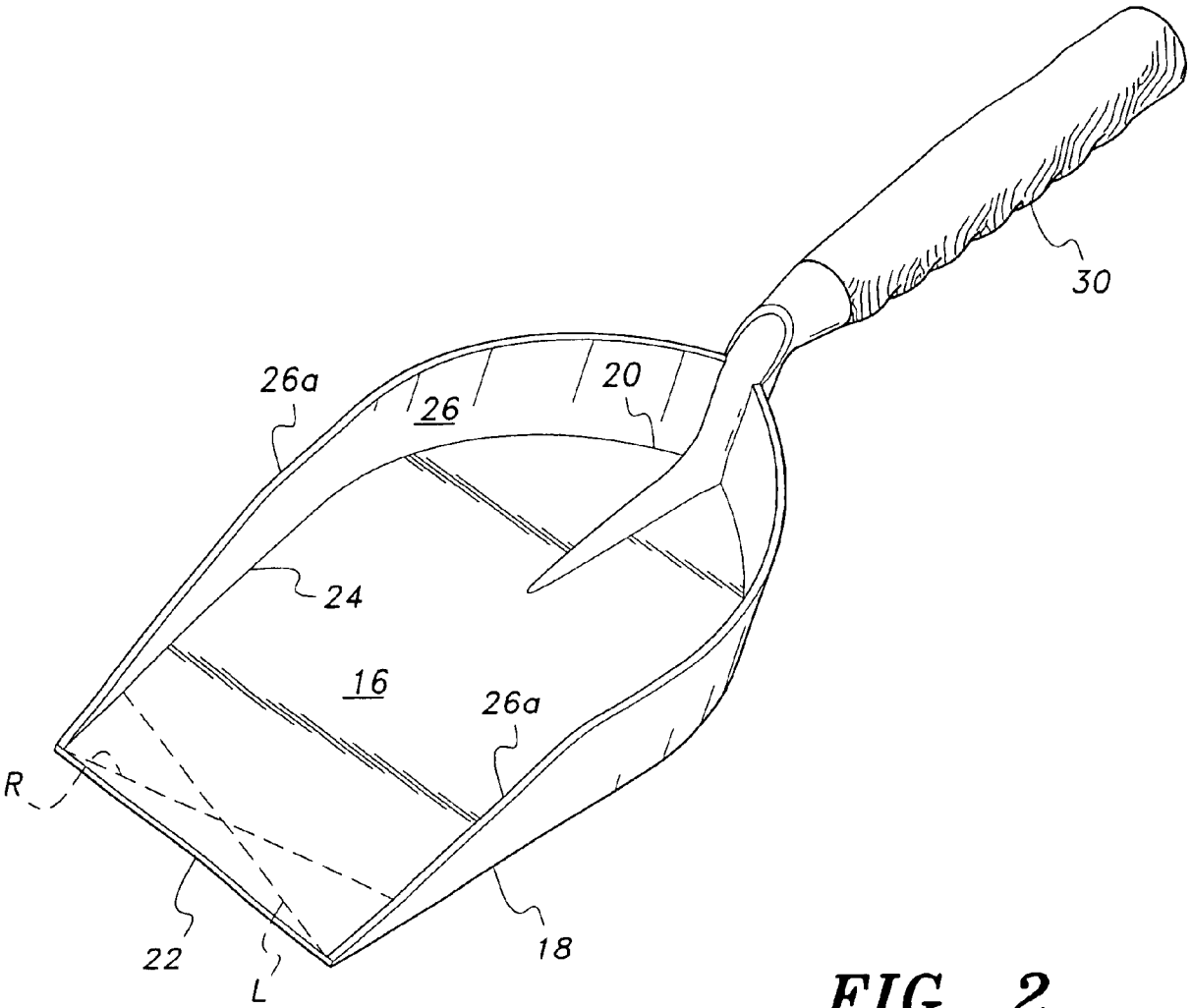
FIG. 2 is a top, perspective view of a hand trowel according to the present invention.
Figure 3:
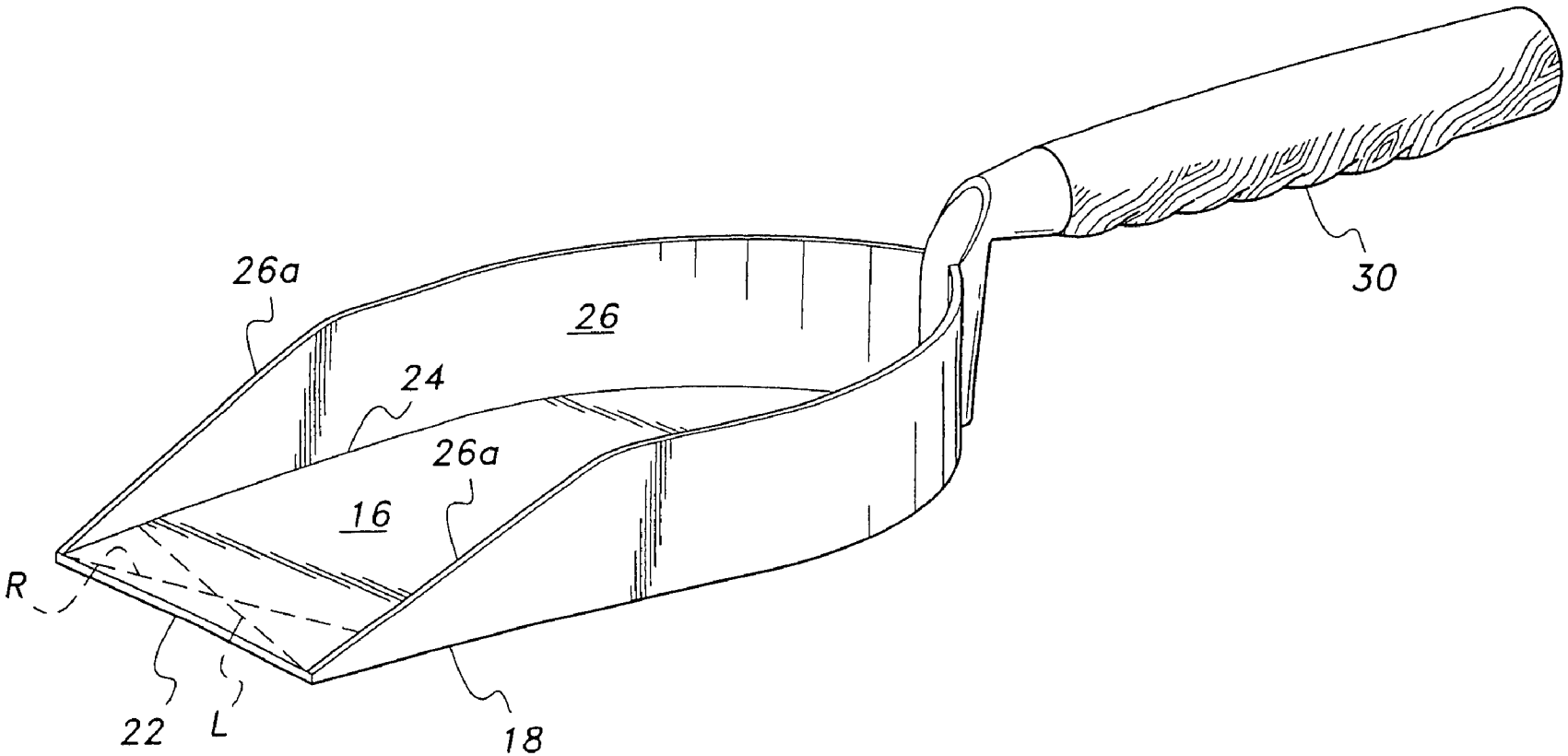
FIG. 3 is a side, perspective view of a hand trowel according to the present invention.

As best seen in FIGS. 2 and 3, trowel 10 comprises a flat plate member having a planar upper surface 16, a planar under surface 18, a rear end 20, a front edge 22 and two side edges 24. An upstanding wall 26 encloses rear end 20 and the two side edges 24. An ergonomic handle 30 is attached to wall 26 at the rear end 20 of the plate member. Wall 26 is perpendicular to upper surface 16 of the flat plate member and is provided with a top edge **26*a*. Top edge 26*a* is at its highest point at the rear of the plate member adjacent handle 30. At approximately two-thirds of each respective side edge's total length as measured from rear end 20, each respective top edge 26*a* of wall 26 begins to taper gradually downward along both side edges until wall 26 is coincident with front edge 22. This design permits the front edge 22 to be unobstructed by side wall structure and allows the mason to trim and point excess grout. If used by a right-handed person, edge 22 will be slanted along the line R. If used by a left-handed person edge 22 will be slanted along the line L. The plate member and wall 26** are preferably fabricated from metallic material.

It is to be understood that the present invention is not limited to the embodiment described above, but encompasses any and all embodiments within the scope of the following claims.

I claim:

1. A hand trowel, comprising:

a flat plate member fabricated from metallic material, the flat plate member having a planar upper surface, a planar undersurface, a rear end, a front edge and two side edges, wherein the flat plate member defines a horizontal plane and the front edge constitutes the leading edge of the plate member;

an upstanding wall fabricated from metallic material, said upstanding wall being attached to the flat plate member and perpendicular thereto, the upstanding wall having a length and a top edge, the upstanding wall enclosing the rear end and the two side edges, wherein the top edge of the wall member gradually tapers downward along the two side edges until the wall is coincident with the front edge, wherein said front leading edge is slanted at an angle in the horizontal plane and extends from one of said two side edges towards the other of said two side edges; and a handle attached to the wall member at the rear end thereof, said handle having an ergonomic design.

* * * * *